US009802334B2

(12) United States Patent
Bricher

(10) Patent No.: US 9,802,334 B2
(45) Date of Patent: Oct. 31, 2017

(54) CUTTER HEAD ASSEMBLY FOR A KNIFE PLANER

(71) Applicant: Kimwood Corporation, Cottage Grove, OR (US)

(72) Inventor: Richard Bricher, Cottage Grove, OR (US)

(73) Assignee: Kimwood Corporation, Cottage Grove, OR (US)

( * ) Notice: Subject to any disclaimer, the term of this patent is extended or adjusted under 35 U.S.C. 154(b) by 706 days.

(21) Appl. No.: 14/328,584

(22) Filed: Jul. 10, 2014

(65) Prior Publication Data

US 2016/0008999 A1 Jan. 14, 2016

(51) Int. Cl.
*B27G 13/04* (2006.01)
*B27G 13/02* (2006.01)

(52) U.S. Cl.
CPC ..... *B27G 13/04* (2013.01); *B27G 13/02* (2013.01)

(58) Field of Classification Search
CPC .... A01G 23/091; A01G 23/06; A01G 23/067; B27G 13/00; B27G 13/02; B27G 13/04; B27G 13/06; B27G 13/08; B27G 13/10; B27G 13/12; B27C 1/005; B27C 1/02; B27C 1/04; B27C 1/14
See application file for complete search history.

(56) References Cited

U.S. PATENT DOCUMENTS 631,542 A 8/1899 Ihle
632,618 A 9/1899 Anderson
793,097 A 6/1905 Rice
811,768 A 2/1906 Forbes
853,170 A 5/1907 Gray
872,890 A 12/1907 Blood
934,436 A 9/1909 Gray
943,540 A 12/1909 Harrold
954,146 A 4/1910 Stevens
995,024 A 6/1911 Mitchell
995,040 A 6/1911 Stevens
1,112,085 A 9/1914 Orton
1,137,216 A 4/1915 Klingborg
1,153,910 A 9/1915 Harrold
1,298,737 A 4/1919 Lane et al.
1,305,650 A 6/1919 Heggen
(Continued)

FOREIGN PATENT DOCUMENTS

EP 0073595 B1 11/1986
EP 0178508 B1 11/1988
(Continued)

*Primary Examiner* — Matthew G Katcoff
(74) *Attorney, Agent, or Firm* — Klarquist Sparkman, LLP

(57) ABSTRACT

A cutter head assembly for a planing apparatus comprises a rotatable cutter head body, at least a first slot and a gib assembly positionable in the first slot to retain a planing knife blade. The cutter head body has a first end, an opposite second end and an outer periphery extending between the first and second ends in a longitudinal direction. The first slot is formed in the outer periphery and extends generally longitudinally. A section of the first slot has at least one profiled side and an opposite knife blade side. The gib assembly is positionable to retain a knife blade in the first slot adjacent the knife blade side. The gib assembly comprises an elongate gib having a section with a shaped leading side and an opposite trailing side. A gib screw is rotatable to move the gib toward the knife blade and clamp it.

19 Claims, 8 Drawing Sheets

(56) References Cited

U.S. PATENT DOCUMENTS

| | | | |
|---|---|---|---|
| 1,315,536 | A | 9/1919 | Usher |
| 1,478,649 | A | 12/1923 | Gustafson |
| 1,524,542 | A | 1/1925 | Divers |
| 1,713,066 | A | 5/1929 | Wolf |
| 1,830,813 | A | 11/1931 | Tautz |
| 1,951,101 | A | 3/1934 | Miller |
| 2,395,287 | A | 2/1946 | Miller |
| 2,449,605 | A | 9/1948 | Kelton |
| 2,822,839 | A | 2/1958 | Frodermann |
| 2,964,079 | A | 12/1960 | Johnson |
| 3,017,912 | A | 1/1962 | Sybertz et al. |
| 3,039,503 | A | 1/1962 | Mainone |
| 3,776,289 | A | 12/1973 | Boboltz et al. |
| 3,785,417 | A | 1/1974 | Vora |
| 3,865,164 | A | 2/1975 | Sybertz |
| 3,945,474 | A | 3/1976 | Palmer |
| 3,987,525 | A | 10/1976 | Hasfjord |
| 4,009,742 | A | 3/1977 | Ziegelmeyer |
| 4,055,101 | A | 10/1977 | Collins |
| 4,068,694 | A | 1/1978 | Schmidt et al. |
| 4,074,737 | A | 2/1978 | Stewart |
| 4,194,545 | A | 3/1980 | Kostermeier |
| 4,243,085 | A | 1/1981 | Gemmani |
| 4,347,882 | A | 9/1982 | Bachmann |
| 4,533,287 | A | 8/1985 | Hagemeyer et al. |
| 4,658,875 | A | 4/1987 | Grabovac |
| 4,850,406 | A | 7/1989 | Krautzberger |
| 4,907,631 | A | 3/1990 | Krautzberger |
| 4,922,971 | A | 5/1990 | Grantham |
| 5,002,104 | A | 3/1991 | Stewart |
| 5,163,490 | A | 11/1992 | Meis |
| 5,240,192 | A | 8/1993 | Tilby et al. |
| 5,337,812 | A | 8/1994 | Schmitt |
| 5,456,300 | A | 10/1995 | Rosenkranz et al. |
| 5,558,142 | A | 9/1996 | Ehrle et al. |
| 5,653,275 | A | 8/1997 | Stewart |
| 5,904,193 | A | 5/1999 | Kellner |
| 6,092,573 | A | 7/2000 | Zaiser |
| 6,095,210 | A | 8/2000 | Parks |
| 6,119,741 | A | 9/2000 | Rowe et al. |
| 6,164,352 | A | 12/2000 | Simonsen |
| 6,279,444 | B1 | 8/2001 | Kellner et al. |
| 6,290,436 | B1 | 9/2001 | Qvarth |
| 6,523,768 | B2 | 2/2003 | Recker et al. |
| 6,644,369 | B1 | 11/2003 | Chiang |
| 6,896,017 | B2 | 5/2005 | Rankin, Sr. |
| 6,968,879 | B2 | 11/2005 | Schuh et al. |
| 6,997,650 | B2 | 2/2006 | Voigt et al. |
| 7,069,969 | B2 | 7/2006 | Knappett et al. |
| 7,108,040 | B2 | 9/2006 | Whittemore |
| 7,182,112 | B2 | 2/2007 | Meados |
| 7,343,946 | B2 | 3/2008 | Stager |
| 7,390,151 | B2 | 6/2008 | Martin et al. |
| 7,735,531 | B2 | 6/2010 | Gilbert et al. |
| 7,954,523 | B2 | 6/2011 | Liu |
| 8,251,112 | B1 | 8/2012 | Stewart |
| 8,534,330 | B2 | 9/2013 | Hinchliff |
| 2005/0006001 | A1 | 1/2005 | Meados |
| 2007/0212176 | A1 | 9/2007 | Meados |
| 2011/0044773 | A1 | 2/2011 | Seidel et al. |

FOREIGN PATENT DOCUMENTS

| | | | |
|---|---|---|---|
| EP | 0325577 | B1 | 10/1991 |
| EP | 0851144 | B1 | 6/2003 |
| EP | 1325798 | A1 | 7/2003 |
| EP | 1854604 | B1 | 10/2008 |
| EP | 1992463 | A2 | 11/2008 |
| EP | 1858676 | B1 | 12/2008 |

FIG. 5B
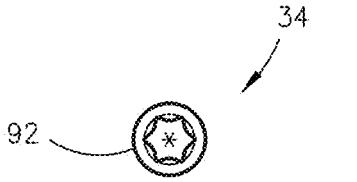
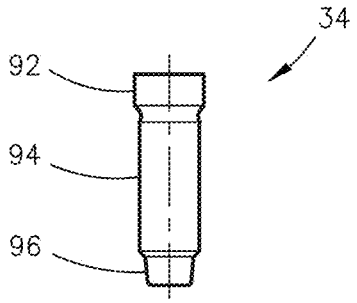
FIG. 5A

CUTTER HEAD ASSEMBLY FOR A KNIFE PLANER

BACKGROUND

This application relates to wood planing, and specifically to a cutter head assembly for a knife planer.

Wood planing machinery such as knife planers are used to finish wood. In some applications, lumber boards are subjected to cutter head finishing operations on each of their four sides in a knife planer to achieve a smooth finish.

Cutter heads have multiple, spaced apart, projecting blades and are rotated at high speed in contact with a wood workpiece to finish it. Over time, the cutter head blades become dull and require resharpening (called "pointing"). As blades wear, they can be adjusted to project from a body of the cutter head by a desired distance. Ultimately, blades wear to an extent where they can no longer be used and must be replaced by new blades.

A component called a gib, which is used in connection with one or more gib screws, is used to secure each blade in its respective slot. The gib and gib screw arrangement allows the blade to be installed and removed, as well as to be adjusted. Because each current gib and gib screw arrangements require substantial angular space around the cutter head body, the number of blades per cutter head of a given diameter is limited.

SUMMARY

Described below are representative implementations of a cutter head assembly that addresses shortcomings of the prior art.

According to one implementation, a cutter head assembly for a planing apparatus comprises a rotatable cutter head body, a first slot and a gib assembly. The cutter head body has a first end, an opposite second end and an outer periphery extending between the first end and the second end in a longitudinal direction. There is at least a first slot formed in the outer periphery and extending generally longitudinally. Viewed in section, the first slot has at least one profiled side and an opposite knife blade side. The gib assembly is positionable to retain a planing knife blade in the first slot at a desired position adjacent the knife blade side. The gib assembly comprises an elongate gib and at least one gib screw. Viewed in section, the gib has a shaped leading side and an opposite trailing side. The gib screw is rotatable to move the trailing side of the gib toward the knife blade side of the slot by contact between the shaped leading side of the gib and the profiled side of the first slot, thereby clamping the planing knife blade between the trailing side of the gib and the knife blade side of the slot.

The foregoing and other objects, features, and advantages of the invention will become more apparent from the following detailed description, which proceeds with reference to the accompanying figures.

BRIEF DESCRIPTION OF THE DRAWINGS

FIGS. 5A and 5B are side elevation and top plan views of the gib screw of FIG. 1.

DETAILED DESCRIPTION

Figure 1:
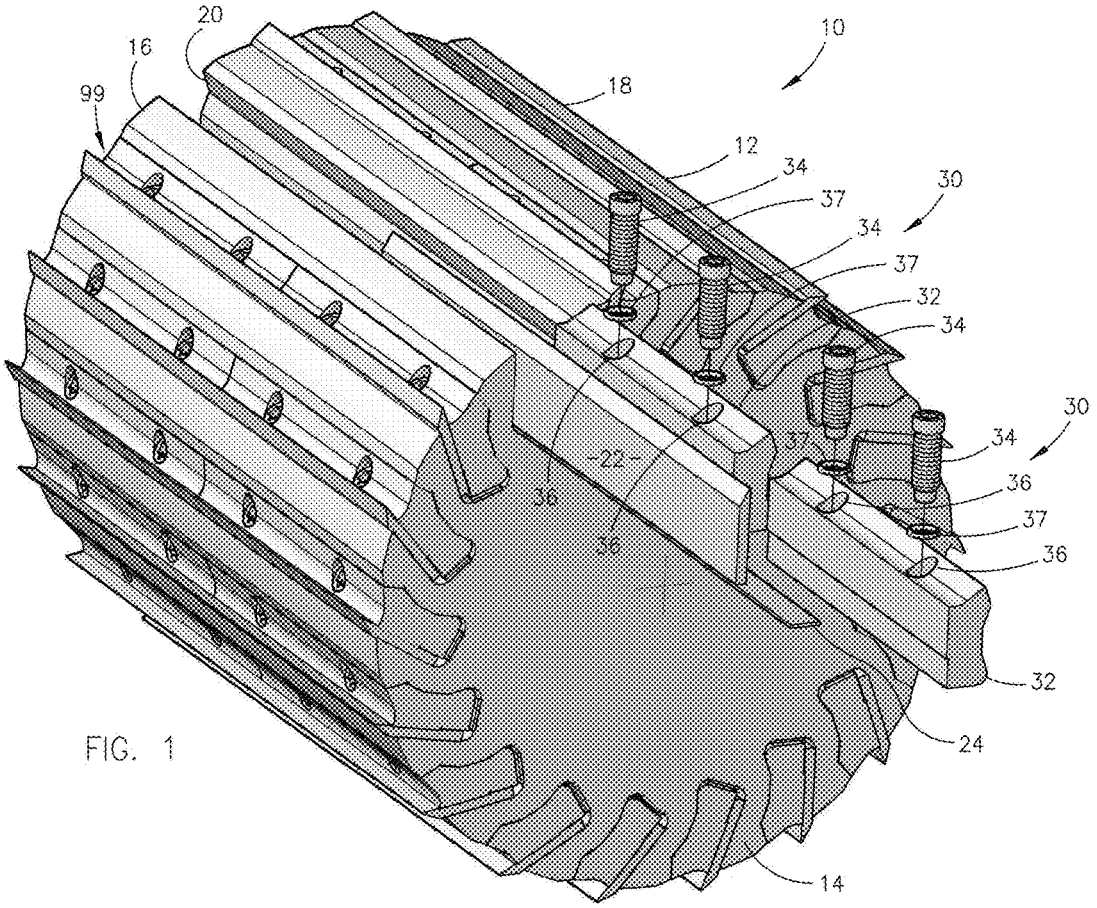
FIG. 1 is a perspective view of a cutter head assembly showing one of the knife blade and gib assemblies partially exploded.

Referring to FIG. 1, a cutter head assembly 10 has a cutter head body 12 rotatable about an axis extending through its end surfaces 14, 16. The cutter head body 12 has an outer periphery or side surface 18 extending between the end surfaces 14 and 16. As shown, at least one slot 20 is formed in the cutter head body 12 and extends generally longitudinally between the end surfaces 14, 16. In the implementation of FIG. 1, there are 18 evenly spaced slots 20. Each slot 20 is configured to receive a knife blade 22 that is held in place within the slot 20 by a gib assembly 30.

For purposes of illustration, the uppermost slot 20 as depicted in FIG. 1 is shown with the knife blade 22 and each of two gib assemblies 30 partially removed to reveal other components. As shown, each gib assembly 30 includes a gib 32, at least one gib screw 34 configured to be received in a gib screw aperture 36 extending through the gib 32. In the example of FIG. 1, each gib 32 has two such gib screws 34 and respective gib screw apertures 36.

Figure 2:
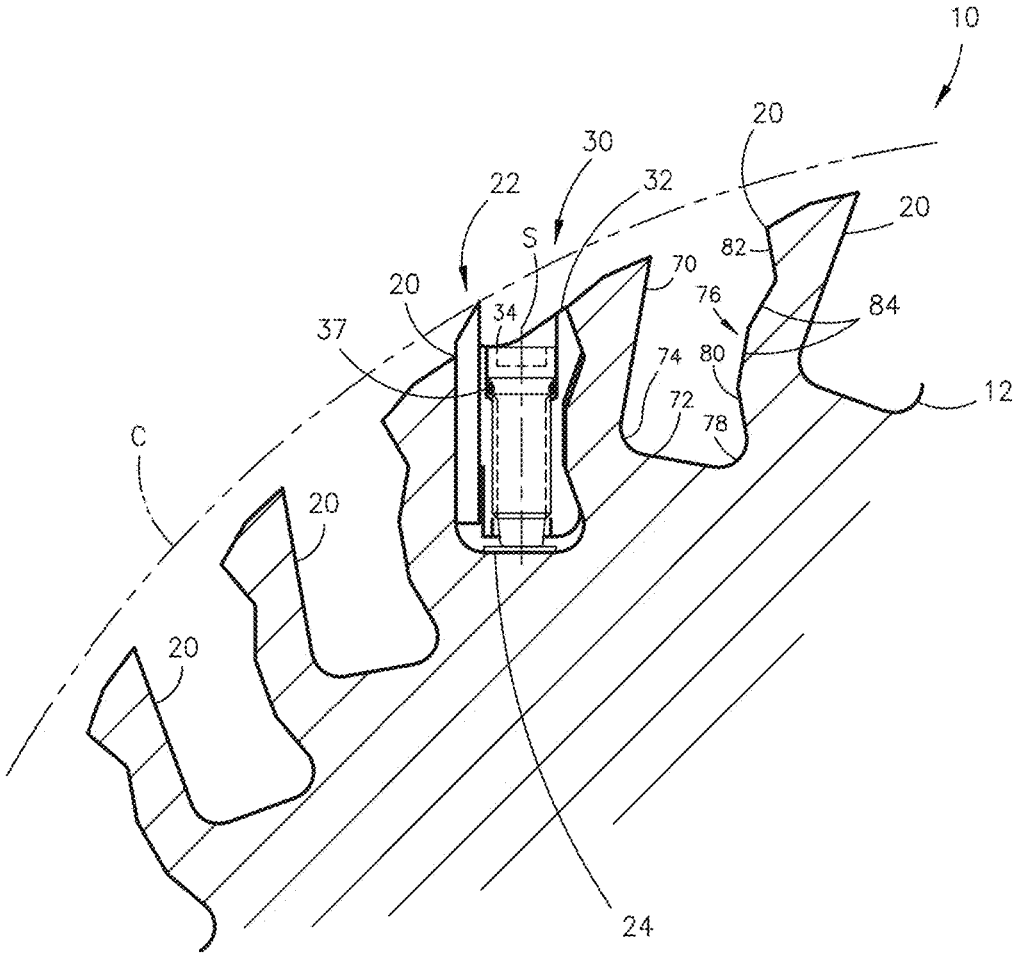
FIG. 2 is a partial end view of the cutter head showing multiple spaced apart slots and a gib assembly and knife blade installed in one of the slots.

Referring to FIG. 2, which is a section of a portion of the cutter head assembly 10, the relative positions of the knife blade 22, the gib 32 and the gib screw 34 as installed in one of the slots 20 are shown. A projecting tip of the knife blade 22 extends beyond the outer periphery 18 of the cutter head body 12 and defines a cutting circle C. The gib screw 34 is tightened or loosened to cause the gib 32 to move within the slot and effect a clamping action on the knife blade 22. In the illustrated implementation, the gib 32 urges the blade 22 against one side of the slot 20 as is described below in greater detail.

Figure 3:
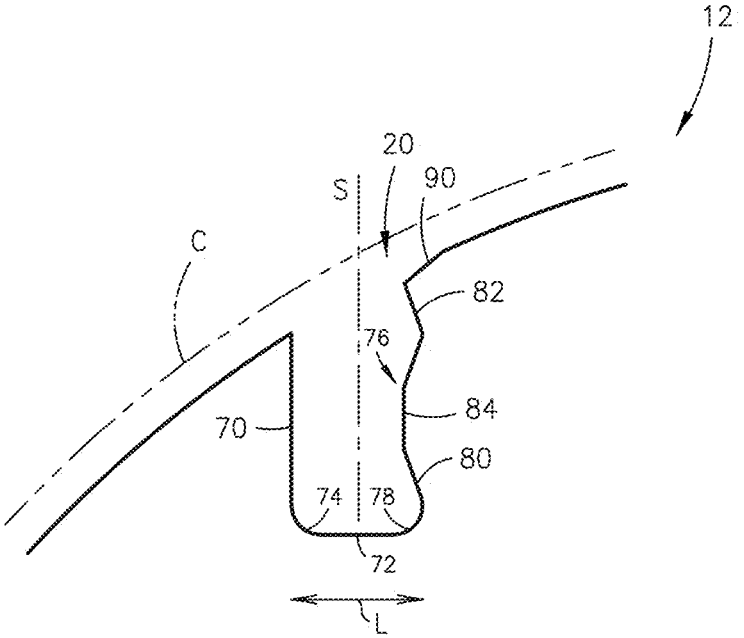
FIG. 3 is a partial end view of the cutter head showing the configuration of a single slot in detail.
Figure 4:
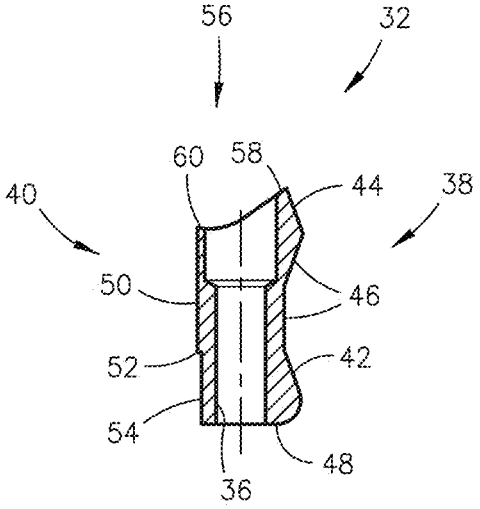
FIG. 4. is a sectioned elevation view of the gib of FIG. 1.

Portions of the gib 32 and the slot 20 have complementary geometry, as is best described in connection with FIGS. 2-4. Referring to FIG. 4, which shows a section of the gib 32, the gib 32 has a shaped leading side 38 (also called a forward side) and an opposite trailing side 40 (also called a rearward side). In the illustrated implementation, the shaped leading side 38 includes a first angled segment 42 and a second angled segment 44 that is spaced away from the first angled segment 42 and one or more intermediate surface(s) 46 separating the first angled segment and the second angled segment. There are two such intermediate surfaces 46 in the implementation shown in FIG. 4. There is a bottom side 48 that connects the leading side 38 and trailing side 40. The trailing side 40 includes a blade mounting surface 50 by which contact between the gib 32 and the knife blade 22 is made.

Optionally, the trailing side 40 may include a recessed surface 54 as shown that is dimensioned to remain spaced apart from the knife blade (see FIG. 2). A minimum knife indicator 52 can be defined at an interface between the blade contacting surface 50 and the recessed surface 54. The minimum knife indicator 52, if present, provides a visual indication to the operator of whether the knife has been worn beyond it usable extent. In addition, by providing a blade contacting surface 50 that is sized and shaped as shown, a clamping force can be achieved as desired, without undesirable point loading. A top side 56 of the gib 32 extends between the leading side 38 and the trailing side 40. In the implementation shown in FIG. 4, there is forward top side region 58 and a rearward top side region 60.

Referring again to FIG. 2, and particularly to the labeled empty slot, the illustrated section of slot 20 can be described as having a rearward side 70 (also called the knife blade side), a bottom side 72 and a forward side 76 (also called the profiled side). The bottom side 72 is joined to the rearward side 70 at a radiused corner 74. Similarly, the bottom side 72 is joined to the forward side 76 at a radiused corner 78. The profiled side 76 has at least a first angled segment 80 and a second angled segment 82. As illustrated, the second angled segment 82 is spaced apart from the first angled segment 80 by at least one intermediate surface 84. In the specific implementation shown, there is one intermediate surface 84 extending approximately parallel to the rearward side 70 and another intermediate surface 84 angled forwardly or in a diverging direction.

As shown in FIGS. 1-4, and with specific reference to FIG. 2, the gib 32 and the slot 20 have respective angled segments configured for contact with each other and to effect a clamping action against the blade 22. That is, the first angled segment 42 of the gib is configured to complement the first angled segment 80 of the slot. Similarly, the second angled segment 44 of the gib 32 is configured to complement the second angled segment 82 of the slot 20. The gib screw 34 is dimensioned to extend through the gib screw aperture 36 and into direct contact with the bottom side 72 of the slot, or, as illustrated, an optional insert 24 positioned to protect the bottom side 72. As the gib screw 34 is threaded or unthreaded relative to the gib 32, the gib 32 moves along the slot axis S and also moves laterally along the axis L due to the wedging action of the angled segments in contact with each other. The first angled segments can be described as defining a first convergent angle relative to the slot axis S in the direction from the bottom side of the slot outward. Similarly, the second angled segments 44, 82 can be described as defining a second radially converging angle relative to the slot axis S.

In the illustrated implementation, the first angled segment 42 and the first angled segment 80 are configured to have approximately the same angular dimension, but in alternative implementations, these angles could differ. Similarly, the second angled segment 44 and the second angled segment 82 have approximately the same angular dimension in the illustrated implementation, but these angles could differ. Further, the first angled segments 42, 80 may have angles that differ from the second angled segments 44, 82. In one implementation, the angled segments 42, 44, 80 and 82 are dimensioned to have angles of approximately 5-30°. In another implementation, the angled segments 42, 44, 80 and 82 are dimensioned to have angles of approximately 15-25°. In yet another specific implementation, the angled surfaces 42, 44, 80 and 82 are dimensioned to have angles of approximately 20°.

As shown in FIGS. 5A and 5B, the gib screw 34 has a head 92, a shaft 94 and an end 96. The head 92 may have any suitable configuration. In the illustrated implementation, the head 92 is configured to have a socket head configuration, such as to receive a Torx® bit (another type of a bit, such as an Allen key, could also be used).

Figure 6C:
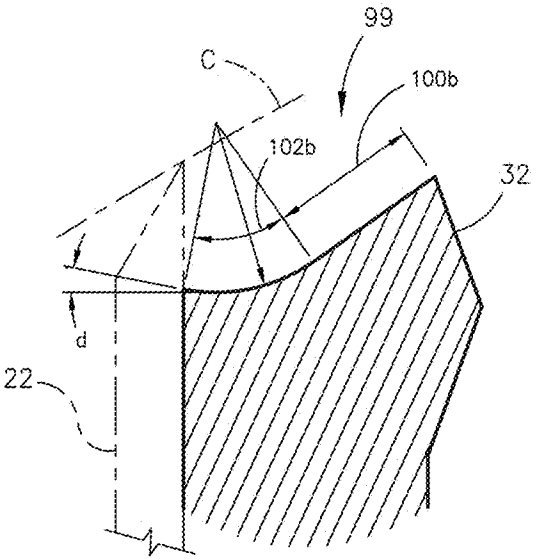
FIGS. 6A, 6B and 6C are elevation views of representative geometries of an outer side of the gib.
Figure 6B:
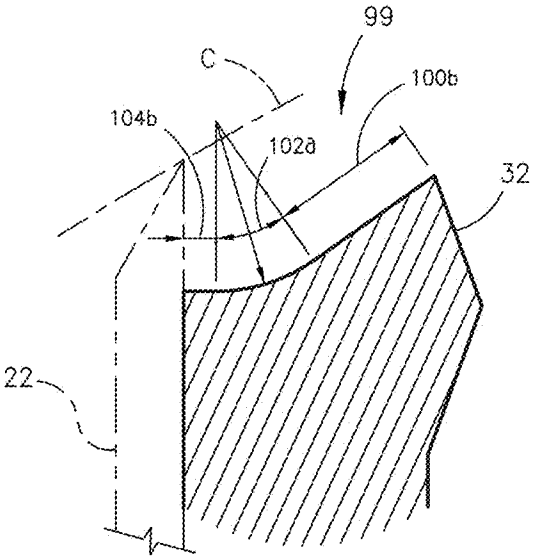
Figure 6A:
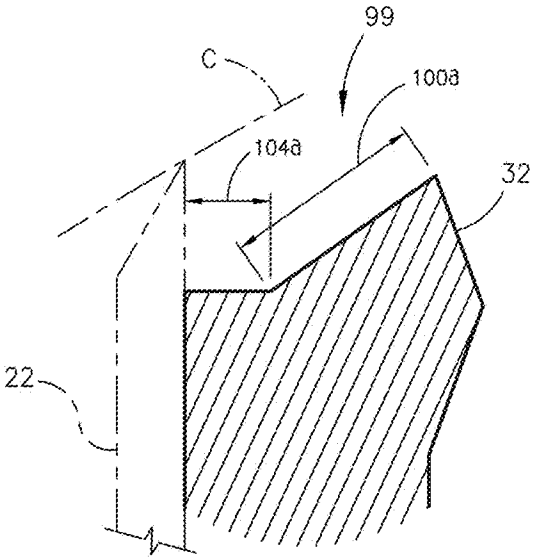

Over time, the gib 32 may wear. In particular, the gib 32 can be shaped to focus wear to occur along its top side 56 and in a relieved region 99 by directing shavings away from the cutterhead. The wear that occurs on the gib 32 tends to reduce wear on the adjacent section of the cutter head body 12, which is advantageous because the gib 32 can be replaced relatively easily and inexpensively. FIGS. 6A, 6B and 6C illustrate alternative configurations for the relieved region 99 on the top side 56 of the gib 32.

In FIG. 6A, a section of the profile of the relieved region 99 has an angled leading segment 100*a* that intersects an angled segment 104*a*.

In FIG. 6B, the relieved region 99 has a leading angled segment 100*b* joined to a radiused segment 102*a*, which is in turn joined to an angled segment 104*b*. In some implementations, the segment 104*b* is not present.

In FIG. 6C, the relieved region 99 is defined by an angled segment 100*b* which is joined to a radiused segment 102*b*. As indicated, the radiused segment 102*b* is slightly upturned by an angle d at the trailing side of the gib 32. A specification implementation, the angle d is approximately 11°, but could be in the range from about 0° to about 30°.

Figure 7:
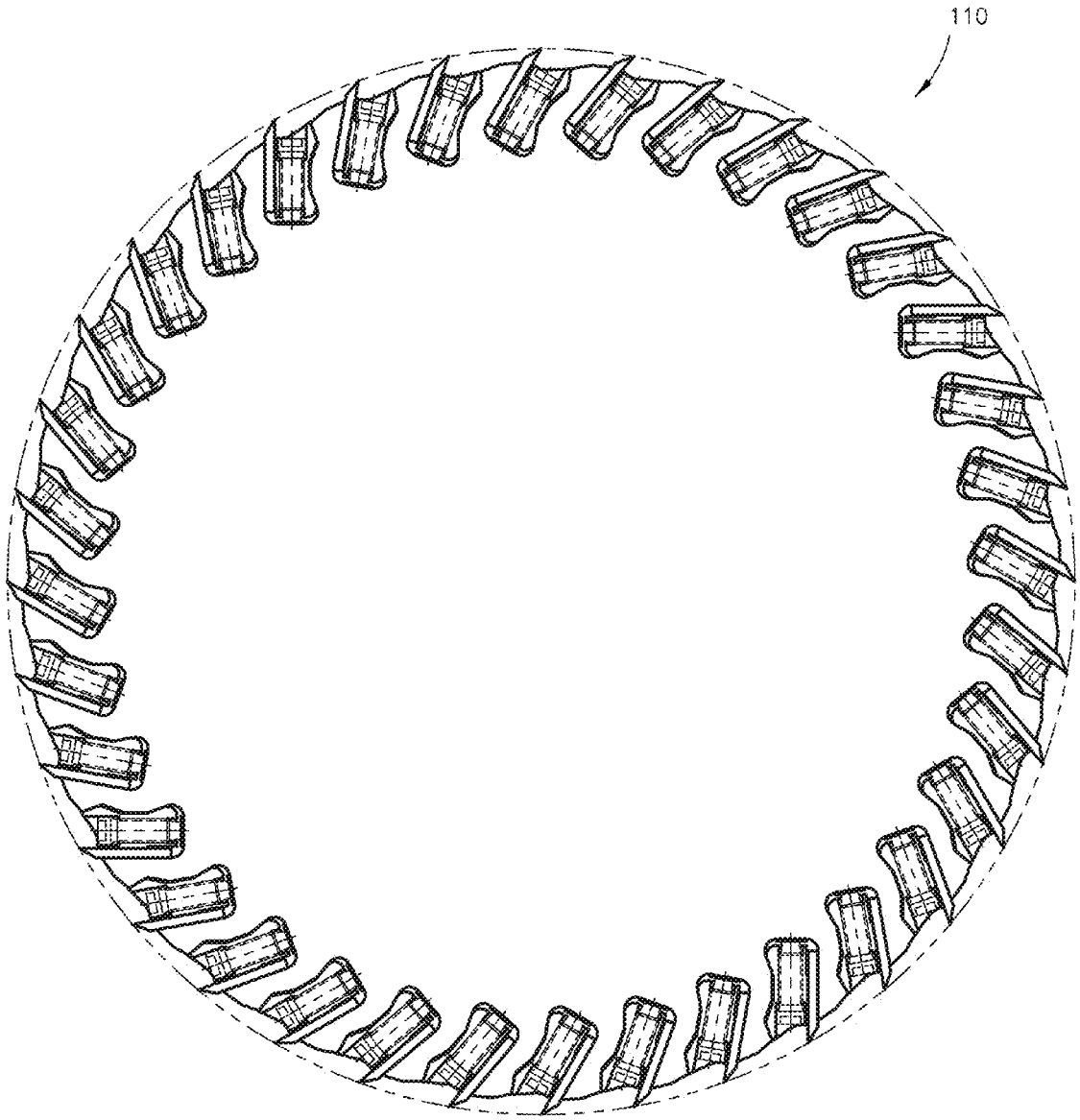
FIG. 7 is an end view of a large cutter head assembly having the same slot and gib assembly configuration as shown in FIG. 1.
Figure 8:
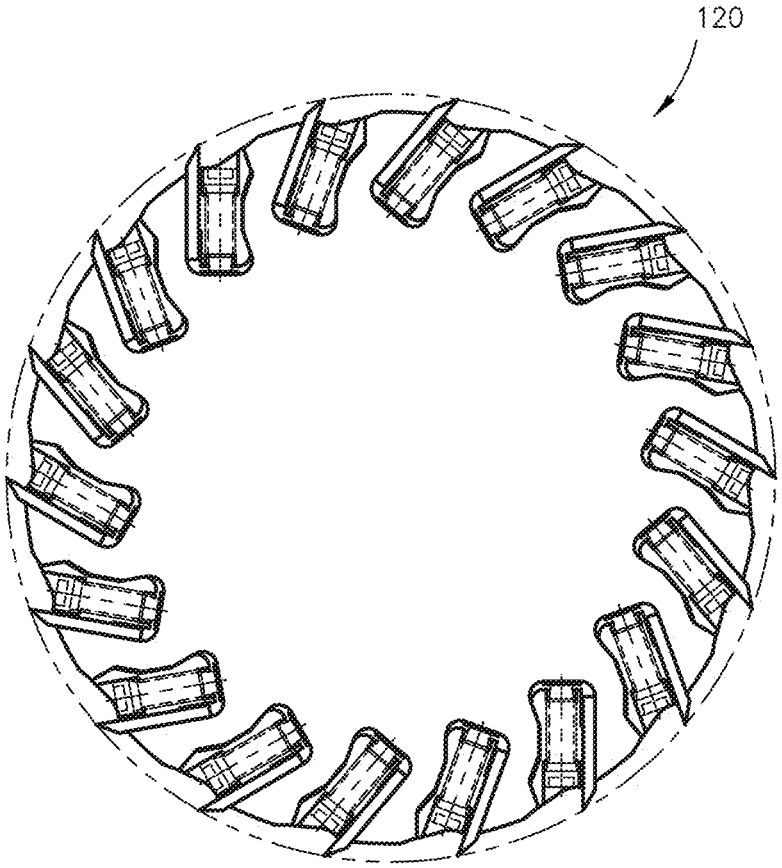
FIG. 8 is an end view of a small cutter head assembly having the same slot and gib assembly configuration as shown in FIG. 1.

The described approaches for positioning and retaining a cutting blade can be implemented in any suitable configuration. For example, FIG. 7 shows a large cutter head 110 having 36 slots and blades. In contrast, FIG. 8 shows a small cutter head 120 having 18 slots and blades, similar to FIG. 1. Of course, it would be possible to implement the same approach in a cutter head having more slots or fewer slots than the cutter heads 110, 120.

The cutter head body 12 can be made of any suitable material, such as a high carbon steel. The gib 32 and gib screw 34 are also formed of suitable materials such as high carbon steel and/or tool steel. The knife blade 22 can be any commercially available knife blade, such as those sold by Global Tooling and Supply of Eugene, Oreg.

One suitable seal 37 is the Parker Model 2-010N70 seal. The insert 24 can be made of any suitable material, such as metal strapping material.

In the illustrated implementations, the gib and slot are configured to have two sets of angled surfaces. In other implementations, it would be possible to achieve the same benefits using a fewer or greater number of angled surfaces.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope and spirit of these claims.

We claim:

1. A cutter head assembly for a planing apparatus, comprising:

a rotatable cutter head body having a first end, an opposite second end and an outer periphery extending between the first end and the second end in a longitudinal direction;

at least a first slot formed in the outer periphery and extending generally longitudinally, wherein a section of the first slot in elevation has a leading side that is defined relative to a direction of rotation of the cutter head body and is profiled and a trailing side opposite the leading side and trailing the leading side in the direction of rotation;

a gib assembly positionable to retain a planing knife blade in the first slot at a desired position adjacent the trailing side, the gib assembly comprising an elongate gib and at least one gib screw, wherein a section of the gib in elevation has a shaped gib leading side, and an opposite gib trailing side, a gib bottom side extending between the gib leading side and the gib trailing side, and a gib outer side extending between the gib trailing side and the gib leading side, wherein the shaped gib leading side comprises a first angled segment, a second angled segment, at least one intermediate segment and a radiused segment, the second angled segment extending inwardly from a junction with the gib outer side, the one or more intermediate segments connecting the second angled segment to the first angled segment, and the radiused segment extending from the first angled segment to a junction with the gib bottom side, and wherein the profiled leading side of the first slot has complementary first and second angled segments shaped to contact the first and second angled segments of the gib leading side, respectively, wherein the gib screw is rotatable to move the gib trailing side toward the trailing side of the slot by contact between the angled segments of the shaped gib leading side and the profiled leading side of the first slot, respectively, thereby clamping the planing knife blade between the gib trailing side and the trailing side of the slot.

2. The cutter head assembly of claim 1, wherein the first slot has a slot axis, and the first angled segment of the first slot defines a first angled surface of the leading side angled in a trailing direction relative to the slot axis, and wherein the second angled segment of the first slot defines a second angled surface of the leading side angled in a trailing direction relative to the slot axis.

3. The cutter head assembly of claim 2, wherein the first angled segments of the shaped gib leading side and the profiled leading side of the slot, respectively, define an angle of between about 5 to about 30 degrees relative to the slot axis and the second angled segments of the shaped gib leading side and the profiled leading side of the slot, respectively, define an angle of between about 5 to about 30 degrees relative to the slot axis.

4. The cutter head assembly of claim 2, wherein the first angled segments of the shaped gib leading side and the profiled leading side of the slot, respectively, define an angle of about 20 degrees relative to the slot axis and the second angled segments of the shaped gib leading side and the profiled leading side of the slot, respectively, define an angle of about 20 degrees relative to the slot axis.

5. The cutter head assembly of claim 1, wherein the gib screw is positioned to extend approximately perpendicular to the bottom side.

6. The cutter head assembly of claim 5, wherein the gib screw is configured to bear against the bottom side of the slot directly or indirectly.

7. The cutter head assembly of claim 5, further comprising an insert positioned along the bottom side of the first slot and against which the gib screw is designed to bear.

8. The cutter head assembly of claim 1, wherein the gib comprises at least one gib screw aperture for the at least one gib screw, the gib screw aperture being located in an outer surface defined by the outer side, further comprising a seal positioned in the gib screw aperture and through which the gib screw can be extended.

9. The cutter head assembly of claim 1, wherein the gib trailing side comprises an outer blade contact surface configured to contact the planing knife blade and an inner recessed surface recessed from the blade contact surface and configured not to contact the planing knife blade, wherein a minimum knife indicator is defined at a boundary between the blade contact surface and the recessed surface.

10. The cutter head assembly of claim 1, wherein the first slot defines a slot opening in the outer periphery and a slot axis extending normal to the slot opening, and wherein the first and second angled sides of the profiled leading side of the slot and the first and second angled sides of the gib leading are each angled in a trailing direction relative to the slot axis.

11. The cutter head assembly of claim 1, wherein the trailing side of the first slot comprises a straight segment extending from a slot opening connected to a radiused segment that is connected to the bottom side.

12. The cutter head assembly of claim 1, wherein the gib outer side has a relieved region having a smaller radial dimension than the gib leading side.

13. The cutter head of claim 12, wherein the relieved region of the gib outer side in section comprises a first angled segment joined to a second angled segment.

14. The cutter head of claim 12, wherein the relieved region of the gib outer side comprises a first angled segment, a second angled segment and a radiused segment connecting the first and second angled segments.

15. The cutter head of claim 12, wherein the relieved region of the gib outer side comprises a first angled segment and a radiused segment joined to the first angled segment.

16. The cutter head assembly of claim 1, wherein the first slot has a slot length extending in the longitudinal direction and the gib has a gib length extending in the longitudinal direction, wherein the gib length is shorter than the slot length and is sized such that multiple gibs can be positioned end to end in the first slot.

17. The cutter head assembly of claim 1, the gib outer side comprises a relieved region having a lesser radial dimension than the leading side of the slot and at least two gib screw apertures formed in the gib and extending approximately parallel to the trailing side of the slot.

18. The cutter head assembly of claim 1, wherein with the gib is positionable to define a gap between a gib bottom side and a bottom side of the first slot when the gib screw is tightened to clamp the knife blade against the trailing side of the slot and an end of the gib screw extending across the gap and into direct or indirect contact with the bottom side of the first slot.

19. The cutter head assembly of claim 1, wherein the intermediate segments comprise an angled intermediate segment that is angled relative to a slot axis and a straight segment that is parallel to the slot axis.

* * * * *